US007224239B2

(12) United States Patent
Ulm et al.

(10) Patent No.: US 7,224,239 B2
(45) Date of Patent: May 29, 2007

(54) STRUCTURAL ELEMENT HAVING A COPLANAR LINE

(75) Inventors: Markus Ulm, Menlo Park, CA (US); Joerg Schoebel, Salzgitter (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/974,621

(22) Filed: Oct. 27, 2004

(65) Prior Publication Data

US 2005/0128022 A1 Jun. 16, 2005

(30) Foreign Application Priority Data

Oct. 27, 2003 (DE) ..... 103 50 033

(51) Int. Cl.
*H01P 1/24* (2006.01)

(52) U.S. Cl. ..... 333/22 R

(58) Field of Classification Search ..... 333/22 R, 333/81 A, 245, 246
See application file for complete search history.

(56) References Cited

U.S. PATENT DOCUMENTS 4,313,095 A * 1/1982 Jean-Frederic ..... 333/116
4,413,241 A 11/1983 Bitoune et al.
6,600,384 B2 * 7/2003 Mohwinkel et al. ..... 333/22 R
2004/0085150 A1 * 5/2004 Dove et al. ..... 333/22 R

FOREIGN PATENT DOCUMENTS

| | | |
|---|---|---|
| DE | 953817 | 12/1956 |
| GB | 2 383 199 | 6/2003 |
| GB | 2 395 368 | 5/2004 |
| JP | 8-279 703 | 10/1996 |
| WO | WO 03/105186 | 12/2003 |

* cited by examiner

*Primary Examiner*—Stephen E. Jones
(74) *Attorney, Agent, or Firm*—Kenyon & Kenyon LLP

(57) ABSTRACT

Novel concepts are proposed for line terminations of coplanar lines that are as anechoic as possible, having a neutral wire and two outer conductors that are situated at least from section to section on both sides of the neutral wire, the line termination including at least one resistor element, via which the neutral wire is connected at its end with the two outer conductors. A connection at the end between the two outer conductors exists independently of the at least one resistor element. Alternatively or in supplementation to this, at least one resistor element of the line termination is situated at a slanting angle to the neutral wire, i.e. at an angle which is either greater or less than 90°.

8 Claims, 5 Drawing Sheets

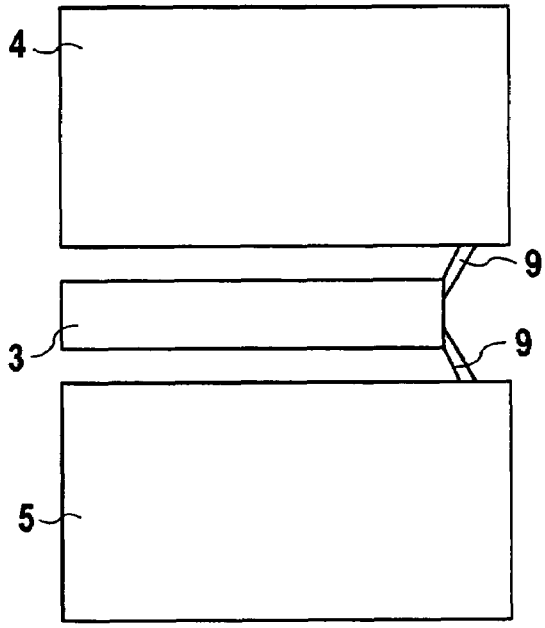
Fig. 5 a
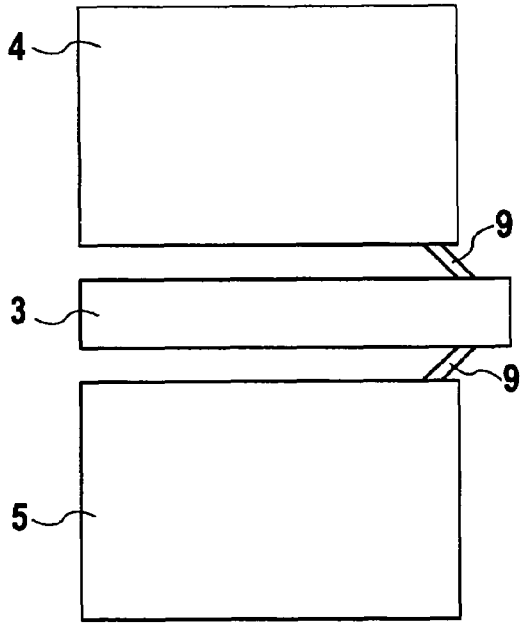
Fig. 5 b
Fig. 6
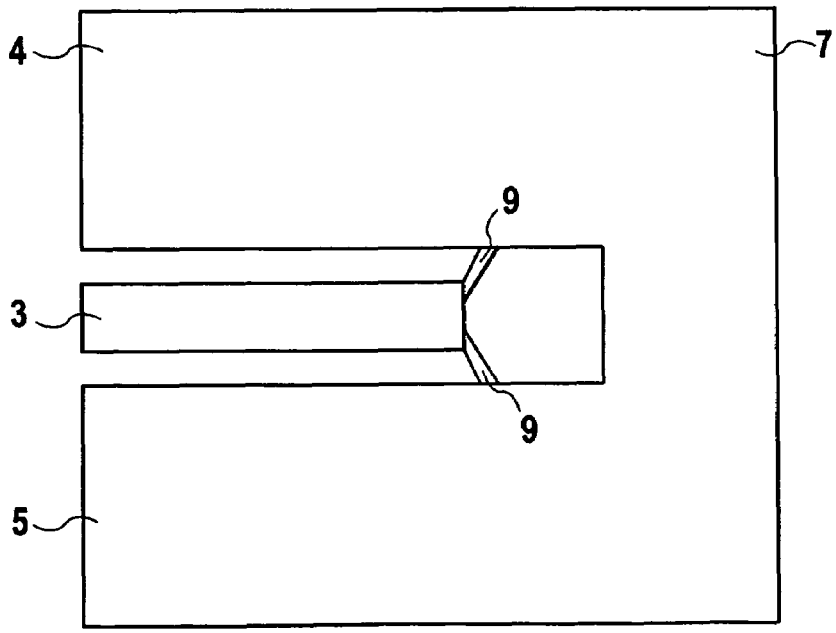

STRUCTURAL ELEMENT HAVING A COPLANAR LINE

FIELD OF THE INVENTION

The present invention relates to a structural element having at least one coplanar line which includes a neutral wire and two outer conductors situated at least from section to section on both sides of the neutral wire. In addition, a line termination is provided for the coplanar line which includes at least one resistor element via which the neutral wire is connected at its ends to the two outer conductors.

BACKGROUND INFORMATION

The technology of coplanar lines (CPWS, coplanar waveguides) is used for high-frequency circuits, particularly in the millimeter wave range, since coplanar lines demonstrate superb high-frequency properties, especially in connection with microelectromechanical switches for high-frequency signals.

The construction of a coplanar line, as it is known from the related art, is shown in FIGS. 1*a* and 1*b*, FIG. 1*a* showing a section through a structural element having a coplanar line and FIG. 1*b* showing a top view onto the surface of the structural element. The structural element is constructed from a substrate 1, which may be made up of a plurality of layers. On uppermost substrate layer 2 there are situated a neutral wire 3 of width w and thickness tW and two outer conductors 4 and 5 having widths $b_a$ and $b_b$ and thicknesses $t_a$ and $t_b$. The two outer conductors 4 and 5 here run parallel to neutral wire 3. The gaps between neutral wire 3 and outer conductors 4 and 5 have the same width $g_a$ and $g_b$, which does not have to be that way for every coplanar line. Neutral wire 3 is used as a signal conductor. The line geometry for a certain impedance at a certain frequency is a function of the material parameters and thicknesses of the substrate layers and the conducting layer in which neutral wire 3 and outer conductors 4 and 5 are implemented. This structure may be covered by one or a plurality of overlayers.

A line termination for a coplanar line which is implemented, for example, on calibration substrates for network analyzers, is shown in FIG. 2. In this application, the line dimensions are relatively small. 50 μm neutral wires are typical. The line termination includes, in this case, two resistor elements 6 which are positioned orthogonally to the direction of the coplanar line, i.e. orthogonally to neutral wire 3 and to outer conductors 4 and 5. The resistor elements are trimmed to a direct current resistance of exactly 50 Ohm (+/−0.3%). Thereby, in the range of 50 . . . 110 GHz, matching of ca 30 . . . −25 dB is achieved. Under ca 26 GHz the matching is better than −35 dB.

SUMMARY OF THE INVENTION

The present invention proposes novel concepts for line terminations of coplanar lines as anechoic as possible.

According to the present invention it is proposed, on the one hand, to implement a connection at the end between the two outer conductors that is independent of the at least one resistor element. Thereby a strip line-like mode may be suppressed, which appears especially in more complex coplanar lines having corners or T junctions. In addition, a connection of the outer conductors, that lies ring-shaped about the termination, suppresses a possible cross feed into other circuit parts.

On the other hand, according to the present invention, it is proposed that one should position at least one resistor element of the line termination at a slanting angle to the neutral wire, i.e. at an angle which is either greater or less than 90°. Thereby a very good matching may be achieved, even when the dimensions of the coplanar line are relatively large. Even in this case, a connection of the outer conductors may be implemented that will suppress the strip line-like mode and a cross feed into other circuit parts. Basically, there are various possibilities for implementing the structural element of the present invention and, in particular, for implementing the connection between the two outer conductors and the implementation of the resistor elements of the line termination. In one advantageous variant of the structural element according to the present invention, both the resistor elements and the connection at their ends between the two outer conductors are formed in the same plane of stratification as the neutral wire and the two outer conductors. However, it is also possible to form the resistor elements and/or the connection at their ends of the outer conductors in a different plane of stratification, as the neutral wire and the two outer conductors, and to connect via through hole plating to the neutral wire and/or outer conductor, so that the resistor elements and/or the connection are implemented in the form of a crossunder or a bridge. As was mentioned before, the resistor elements of the line termination are positioned at a slanting angle to the neutral wire, in one variant of the structural element according to the present invention. For this purpose, the resistor elements may start from the end face of the neutral wire or even from the sides of the neutral wire that are oriented parallel to the outer conductors. In addition, the neutral wire may be formed shorter or longer than the outer conductors, so that the outer conductors project beyond the neutral wire or the neutral wire projects beyond the outer conductors.

BRIEF DESCRIPTION OF THE DRAWINGS

FIGS. 5*a* and 5*b* show a line termination for a coplanar line according to the present invention.

FIG. 6 shows an additional line termination for a coplanar line according to the present invention.

DETAILED DESCRIPTION

Figure 3:
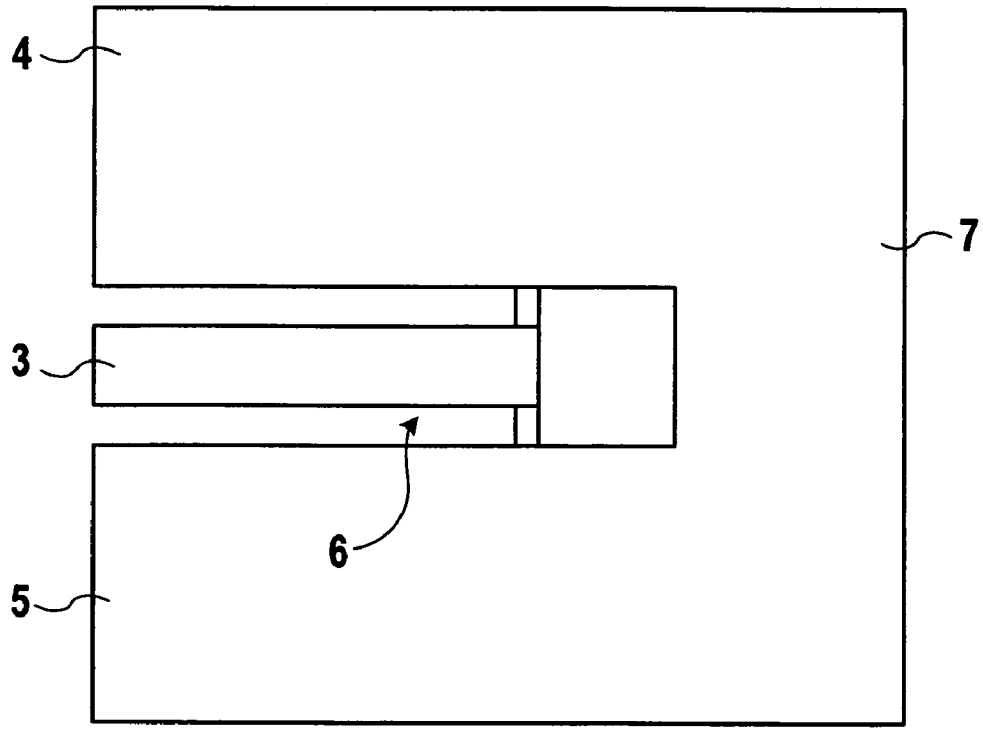
FIG. 3 shows a line termination for a coplanar line according to the present invention.

FIG. 3 shows a top view onto a coplanar line having a neutral wire 3 and two outer conductors 4 and 5 that run parallel to neutral wire 3. Outer conductors 4 and 5 are identical in this case, and they are designed to be substantially wider than neutral wire 3 and situated symmetrically with respect to neutral wire 3. The coplanar line is provided with a line termination which here includes two resistor elements 6, via which the neutral wire 3 at its end is connected to the two outer conductors 4 and 5. Resistor elements 6 are situated orthogonally to neutral wire 3 and to outer conductors 4 and 5, and start from the two sides of neutral wire 3, which are oriented parallel to outer conductors 4 and 5.

According to the present invention, independently of the two resistor elements 6, there is a connection 7 between the two outer conductors 4 and 5, at their ends, so that the end of neutral wire 3 along with its resistor elements is surrounded in circular fashion by the two outer conductors 4 and 5 and their connection 7.

The variant of a line termination shown in FIG. 3 is particularly suitable for applications having small line dimensions. At high frequencies, the reflection factor has a capacitive component in this case.

Figure 4:
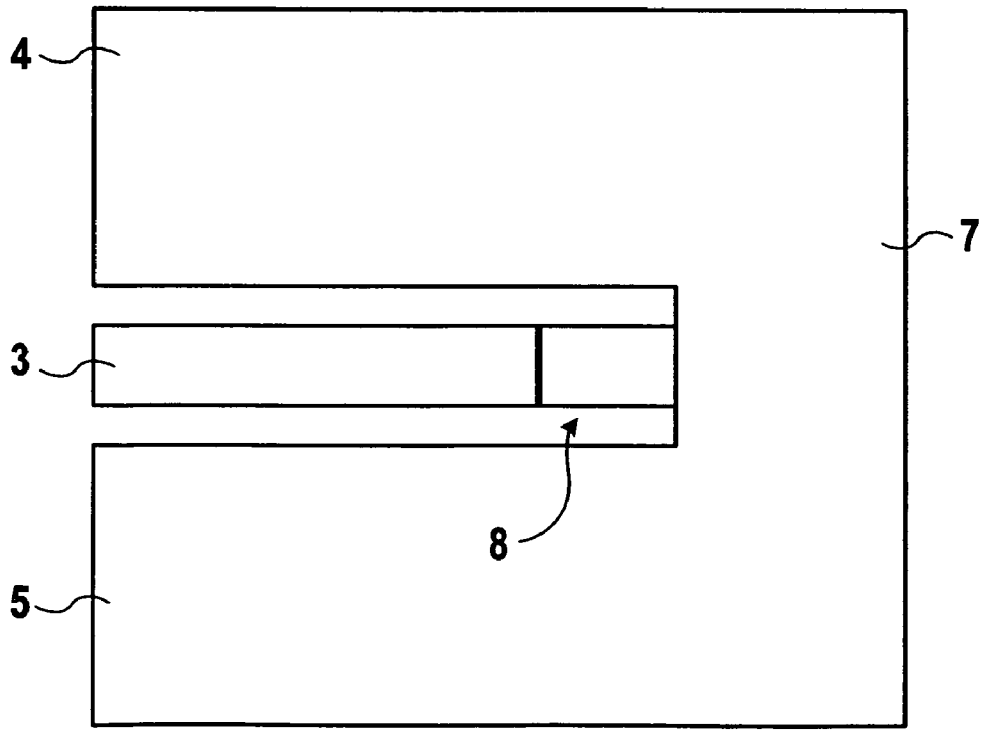
FIG. 4 shows an additional line termination for a coplanar line according to the present invention.

By contrast, the reflection factor of the variant of a line termination shown in FIG. 4 has an inductive component. The coplanar line is formed in this exemplary embodiment in exactly the same way as shown in FIG. 3, having a neutral wire 3 and having outer conductors 4 and 5 connected at their ends. However, in this case the line termination includes only one resistor element 8, which starts at the end face of neutral wire 3 and, as an extension of neutral wire 3, opens out to connection 7 of outer conductors 4 and 5.

Using the line geometry shown in FIG. 4, a good line termination can be achieved for resistor layers having low sheet resistance of typically less than 10 Ω, if the effect of the resistor layer on the line impedance in the geometry of resistor element 8 and in the geometry of the line formed from outer conductors 4 and 5 and resistor element 8 is taken into consideration. The line termination is here quite large, as a rule, so that even larger HF powers are able to be absorbed.

Using the line terminations shown in FIGS. 5 and 6, a very good matching may be achieved even if the dimensions of the coplanar line are comparatively large. Comparatively large means, for example at 77 GHz, that the neutral wire of a coplanar line on a ceramic or a semiconductor substrate is wider than ca 50 ηm. This turns out to be advantageous for the integration of micromechanical structural elements, and also leads to a low damping of the line.

In the line terminations shown in FIGS. 5*a* and 5*b*, outer conductors 4 and 5 are not connected at their ends. The line terminations are formed here respectively by two resistor elements 9, via which neutral wire 3 is connected at its end to both outer conductors 4 and 5, the resistor elements 9 being situated in both cases at a slanting angle to, and symmetrically to the neutral wire. Neutral wire 3 of the variant shown in FIG. 5*a* is formed shorter than the two outer conductors 4 and 5. In this version, resistor elements 9 start from the end face of neutral wire 3, and run forwards slantwise, in the direction of the protruding ends of outer conductors 4 and 5. By contrast, neutral wire 3 of the variant shown in FIG. 5*b* extends beyond the ends of the two outer conductors 4 and 5. In this case, resistor elements 9 start out from the sides of neutral wire 3 that face outer conductors 4 and 5, and run slantwise backwards to the ends of outer conductors 4 and 5.

Using both variants shown in FIGS. 5*a* and 5*b*, a line termination may be achieved using a very small reactive component. The optimal angles at which resistor elements 9 are situated, and the optimal width of resistor elements 9 are a function of the line geometry, the sheet resistance of the resistor layer and the frequency. Since the current distribution on resistor elements 9 at high frequencies is no longer homogeneous, as a rule, it is not sufficient to optimize resistor elements 9 with respect to their direct current resistance. However, optimization may be undertaken with the aid of simulation calculations. The reactive components may be purposefully set and compensated also by shortening or lengthening neutral wire 3 with respect to outer conductors 4 and 5.

The line termination shown in FIG. 6 has the advantage over the variant shown in FIG. 5*a* that, because of connection 7 at the ends of the two outer conductors 4 and 5, parasitic coplanar modes are suppressed and a cross feed to other circuit components may be avoided. Structural components of the kind being discussed herein have application in many fields of technology. In the motor vehicle field, such structural elements may be used, for example, in connection with microwave antennas used as radar distance sensors. Thus, in adaptive speed regulation (adaptive cruise control—ACC), microwave antennas are used which work in the LRR (long range radar) field. Microwave antennas, which work in the SRR (short-range radar) field, are used, for example, within the scope of automatic parking assistance, automatic monitoring of a blind spot and pre-crash air bag release. These microwave antennas are usually constructed as phased array antennas and are advantageously equipped with an electronically swivelable or switch-selectable radiation lobe.

Figure 7:
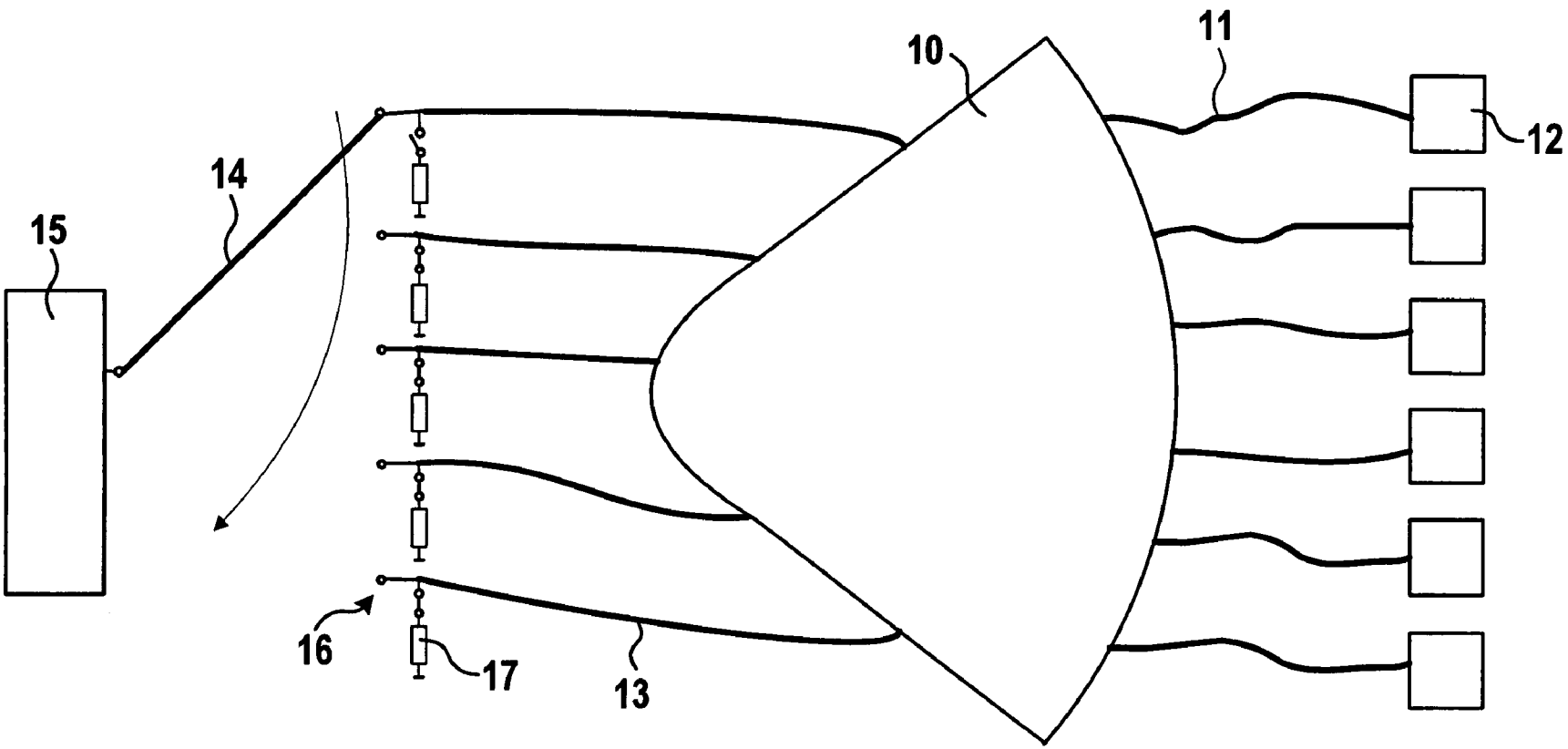

For electronic beam swiveling, a beam shaping network such as a Butler matrix or a Rotman lens may be used, as is shown in FIG. 7. The Rotman lens is produced in this case as a planar structure on millimeter wave substrate having a microstrip transmission line as inputs and outputs. It is made up of etched structures, namely of a lens-shaped parallel-plate line 10 and compensating lines 11 of different lengths, which are connected to antenna elements 12. On the other side of parallel-plate line 1 1, supply lines 13 are connected via a change-over switch 14 to a high-frequency circuit 15. The signals of the individual radiation lobes are picked off and applied from/to supply lines 13. In each supply line 13 a contact element 16 is situated, so that it is possible to activate supply lines 13 sequentially. Contact elements 16 may be implemented in the form of micromechanical switches (MEMS) or in the form of active elements, such as pin diodes, in integrated microcircuits or millimeter-wave circuits (MMICs).

For the functioning of the Rotman lens shown here and also the Butler matrix, it is necessary to terminate all the non-used supply lines 13 anechoically. In this connection, the concept according to the present invention of a line termination may be used in an advantageous manner. The line termination is shown here, in each case, in the form of a resistor element 17 connected to the respective contact element 16.

Figure 1A:
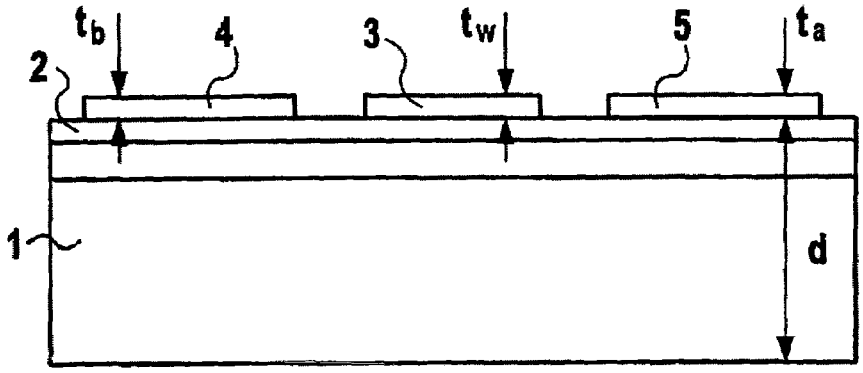
Fig. 1a PRIOR ART
FIGS. 1*a* and 1*b* show the construction of a structural element having a coplanar line (related art).
Figure 1B:
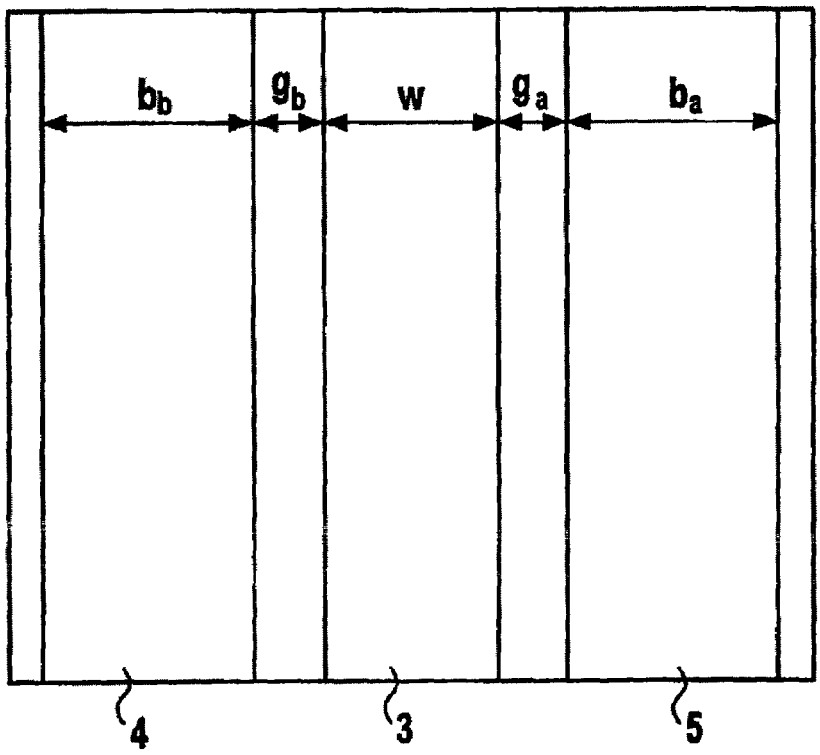
Fig. 1b PRIOR ART
Figure 2:
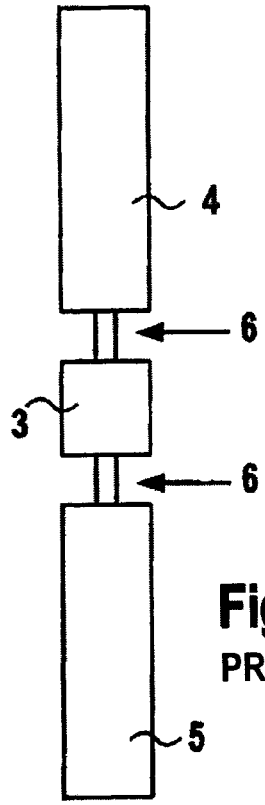
Fig. 2 PRIOR ART
FIG. 2 shows a known line termination for a coplanar line (related art).
Figure 8:
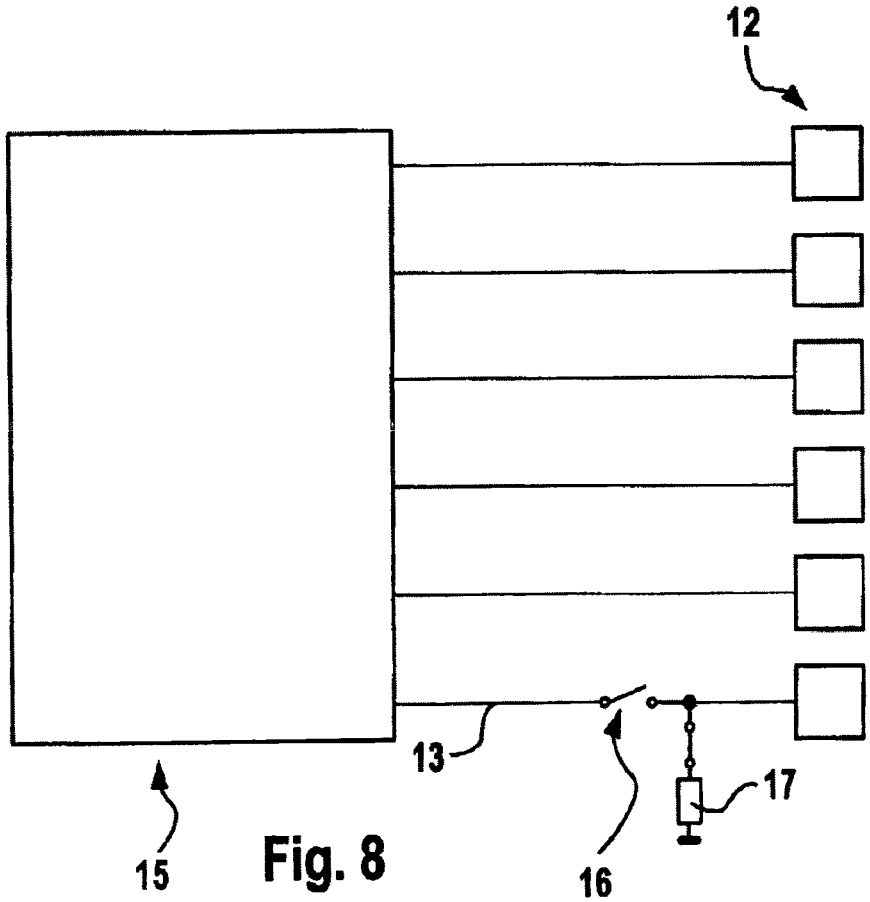
FIG. 7 shows a first application for a structural element according to the present invention and FIG. 8 shows a second application for a structural element according to the present invention.

FIG. 8 shows a reconfigurable, adaptive antenna concept, which may also be used within the scope of radar sensor technology. Here too, the individual antenna elements 12, antenna slots or subgroups of antenna elements 12 of an antenna array are connected via supply lines 13 having a high-frequency circuit 15. In the supply lines 13 there is in each case an absorptive contact element 16, so that parts of the antenna array may optionally be switched on or off. In this context, switched-off antenna elements 12 must be terminated to be as anechoic as possible, to hold to as low as possible the influence on the active antenna part. In this connection too, the concept according to the present invention of a line termination may be used advantageously, which is shown again here in the form of a resistor element 17 that is connected to the respective contact element 16.

Using the concept according to the present invention, described above, of an integrated line termination for integrated HF circuits, one may achieve a good matching for microwaves and millimeter waves. Therefore, this concept may be used in different fields of the technology, for instance, in communications technology, radar technology and satellite technology, as well as in military systems.

What is claimed is:

1. A structural element, comprising:

at least one coplanar line, wherein:

the at least one coplanar line includes a neutral wire and two outer conductors that are situated at least from section to section on both sides of the neutral wire;

a line termination provided for the at least one coplanar line and including at least one resistor element via which the neutral wire is connected at an end thereof to the two outer conductors, wherein:

the at least one resistor element is situated at a slanting angle to the neutral wire, the slanting angle being one of greater and less than 90°; and a connection at an end between the two outer conductors existing independently of the at least one resistor element;

wherein at least one of the at least one resistor element and the connection at the end between the two outer conductors are developed in a different plane of stratification than the neutral wire and the two outer conductors, so that at least one of the at least one resistor element and the connection are implemented as one of a crossunder and a bridge.

2. The structural element as recited in claim 1, wherein:

at least one of the at least one resistor element and the connection at the end between the two outer conductors is developed in the same plane of stratification as the neutral wire and the two outer conductors.

3. The structural element as recited in claim 1, wherein:

the at least one resistor element starts from an end face of the neutral wire.

4. The structural element as recited in claim 1, wherein:

the at least one resistor element starts from a side of the neutral wire that is oriented parallel to the two outer conductors.

5. The structural element as recited in claim 1, wherein:

the neutral wire is one of shorter and longer than the two outer conductors.

6. The structural element as recited in claim 1, wherein:

the structural element is used in an integrated high-frequency circuit including one of an absorptive switch and a calibration substrate.

7. The structural element as recited in claim 1, wherein:

the structural element is used in an integrated high-frequency circuit including one of an absorptive switch and a calibration substrate.

8. The structural element as recited in claim 1, wherein:

an axis of the at least one resistor element is slanted by the slanting angle with respect to an axis of the neutral wire.

* * * * *